United States Patent [19]

Schafer

[11] Patent Number: 4,858,806

[45] Date of Patent: Aug. 22, 1989

[54] TICKET DISPLAY AND DISPENSER

[76] Inventor: Christopher E. Schafer, R.R. 2, Adair, Iowa 50002

[21] Appl. No.: 150,956

[22] Filed: Feb. 1, 1988

[51] Int. Cl.[4] ..... B26F 3/02; B65H 35/10

[52] U.S. Cl. ..... 225/32; 225/6; 225/34; 225/37; 225/39; 225/41; 225/42

[58] Field of Search ..... 225/32, 34, 37, 39, 225/6, 41, 42; 221/155, 30, 154, 34, 72, 73

[56] References Cited

U.S. PATENT DOCUMENTS

| | | | |
|---|---|---|---|
| 1,400,619 | 12/1921 | Marcuse | 225/32 |
| 2,723,718 | 11/1955 | Bright | 225/32 X |
| 4,516,711 | 5/1985 | Barege | 225/32 X |

*Primary Examiner*—Donald R. Schran

*Attorney, Agent, or Firm*—Henderson & Sturm

[57] ABSTRACT

The ticket display and dispenser is a box forming one or more compartments for containing one or more ticket chains made up of a plurality of end-to-end or side-to-side interconnected tickets arranged in series-connected fashion. Each chain of tickets is fed forwardly through a ticket-entry slot for upward travel over a display structure and then rearwardly through a ticket-re-entry slot for exit through a ticket-exit slot at the rear of the box. The open front of the box is closed by a transparent cover that overlies the display structure and tickets displayed thereon. The ticket exit is located at the rear of the apparatus and the cover is lockable in place to prevent unauthorized access to the tickets, usually of the lottery type.

17 Claims, 5 Drawing Sheets

Fig. 6
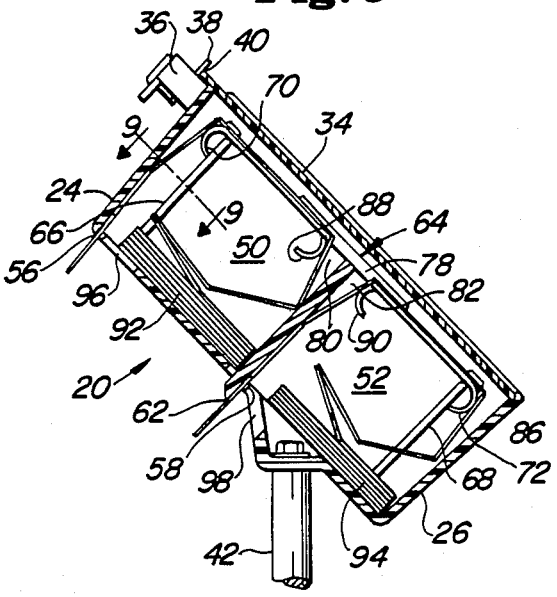
Fig. 7
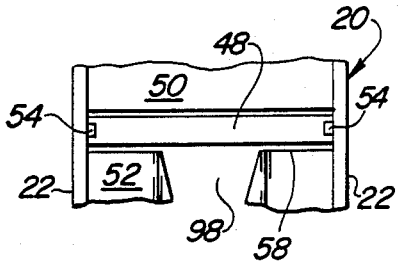
Fig. 8
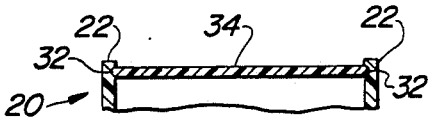
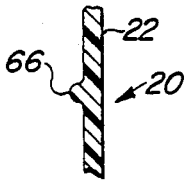
Fig. 9
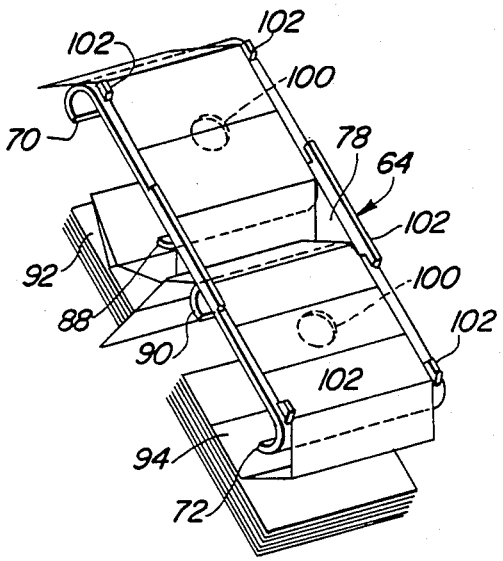
Fig. 10

Fig. 13
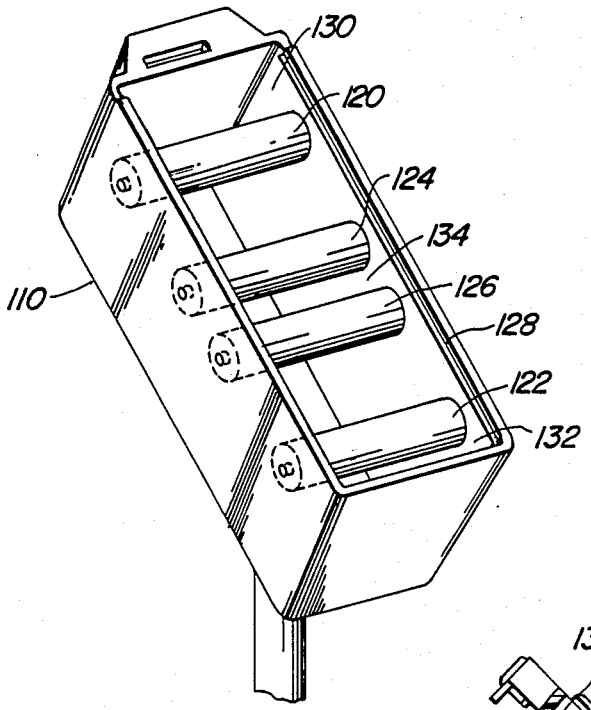
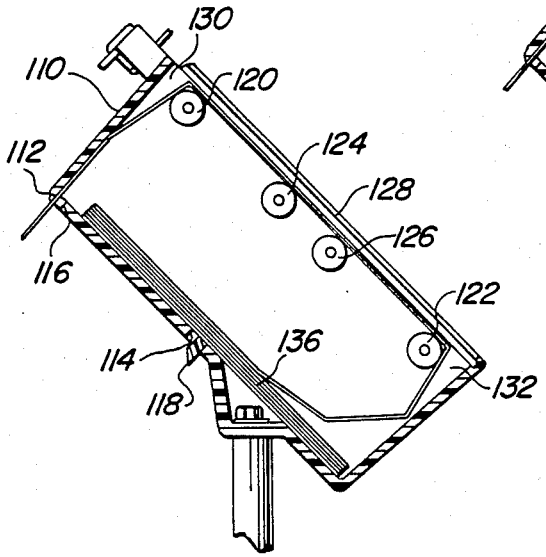
Fig. 14
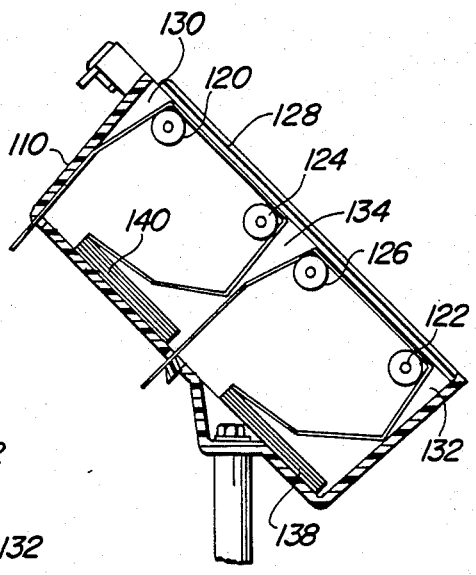
Fig. 15

TICKET DISPLAY AND DISPENSER

BACKGROUND AND SUMMARY OF THE INVENTION

Lottery tickets in many cases are dispensed manually by the simple process of detaching a ticket or tickets according to the requirements of the ticket purchaser. In some instances, display apparatus is provided and is combined with one form or another of means for detaching tickets from the fan-folded stack or "chain" or series when a ticket purchase is made. Presently known systems are at times inefficient, difficult to load and prone to break-down or malfunctioning.

According to the present invention, a simplified and trouble-free display and dispenser is provided, one that displays as well as dispenses tickets in a positive and efficient fashion and one that is virtually immune to break-down. Further, the present apparatus is highly resistant to damage via theft or break-in attempts or otherwise. The inventive dispenser is extremely versatile in that it is capable of handling ticket stacks of different types or two separately-compartmented stacks of the same type, plus displays of both stacks whether similar or unlike. The construction is such that partial disassembly is easily accomplished for replenishing ticket stacks.

Features and advantages other than those noted above will appear as the present disclosure progresses.

DESCRIPTION OF THE DRAWINGS

FIG. 6 is a section through the box and shows the guide and display panel, the cover and the upper and lower compartments containing separate supplies of tickets.

FIG. 7 is a front view as seen along the line 7—7 of FIG. 3.

FIG. 8 is a section as seen along the line 8—8 of FIG. 1.

FIG. 9 is a section as seen along the line 9—9 of FIG. 6.

FIG. 10 is a perspective of the display panel showing the manner of travel of the upper and lower ticket series.

FIG. 13 is a perspective of a modified form of dispenser box.

FIG. 14 is a section of the modified box showing the dispensing of one type of ticket.

FIG. 15 is a similar section showing the dispensing of two forms of ticket.

DETAILED DESCRIPTION OF THE PREFERRED EMBODIMENT OF THE INVENTION

Figure 2:
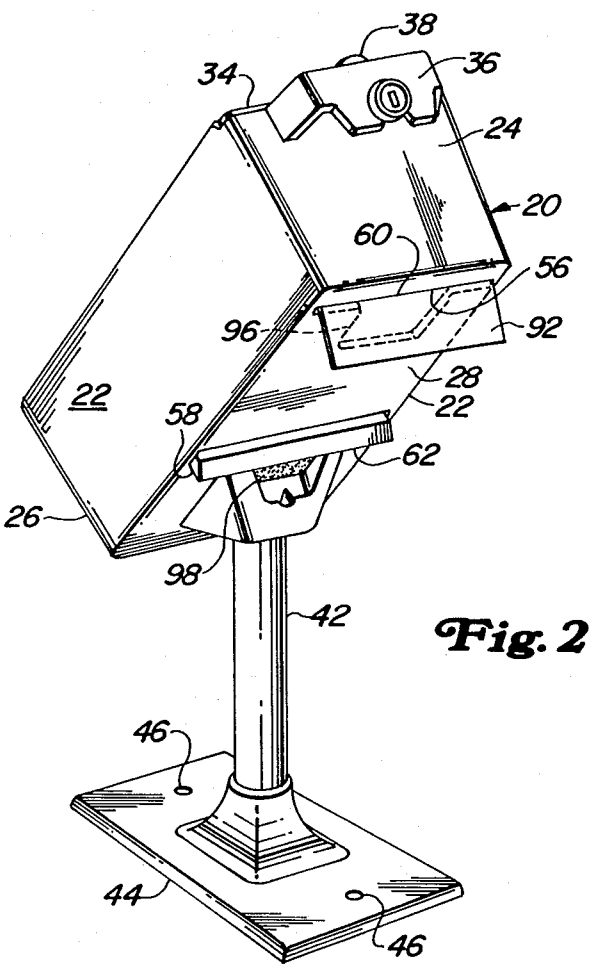
FIG. 2 is a perspective as seen from the rear and the opposite side.
Figure 1:
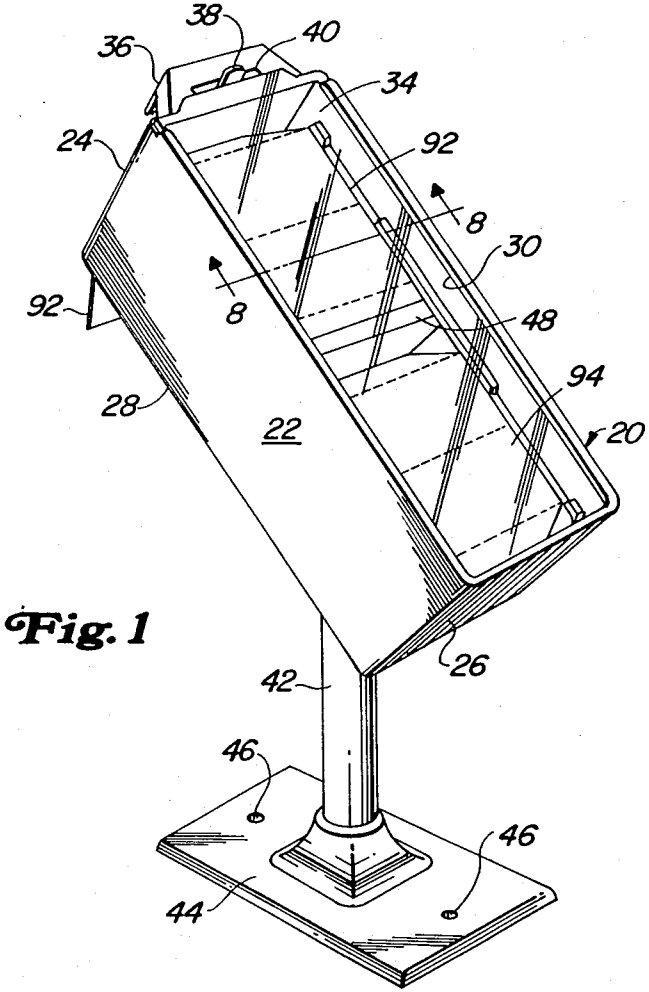
FIG. 1 is a reduced-scale perspective of the dispenser as seen from the front and one side.
Figure 5:
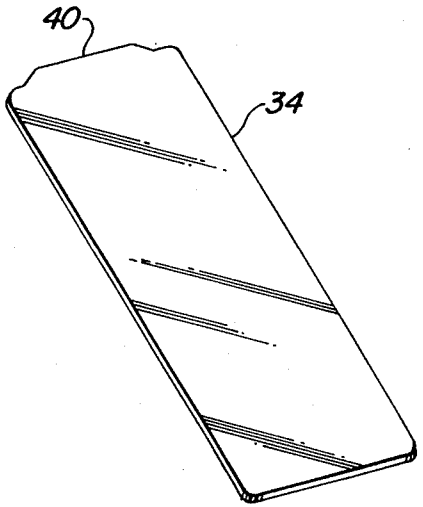
FIG. 5 is a perspective of the transparent cover.
Figure 4:
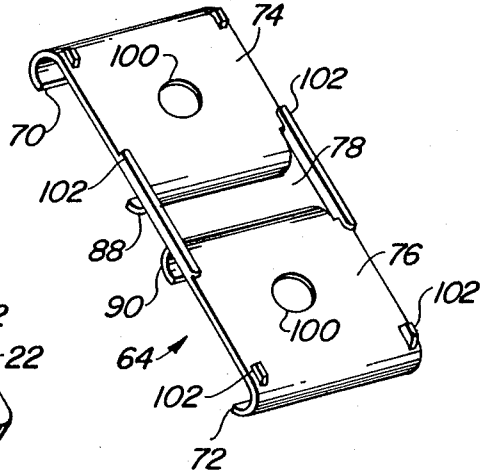
FIG. 4 is a perspective of the display and guide panel.
Figure 3:
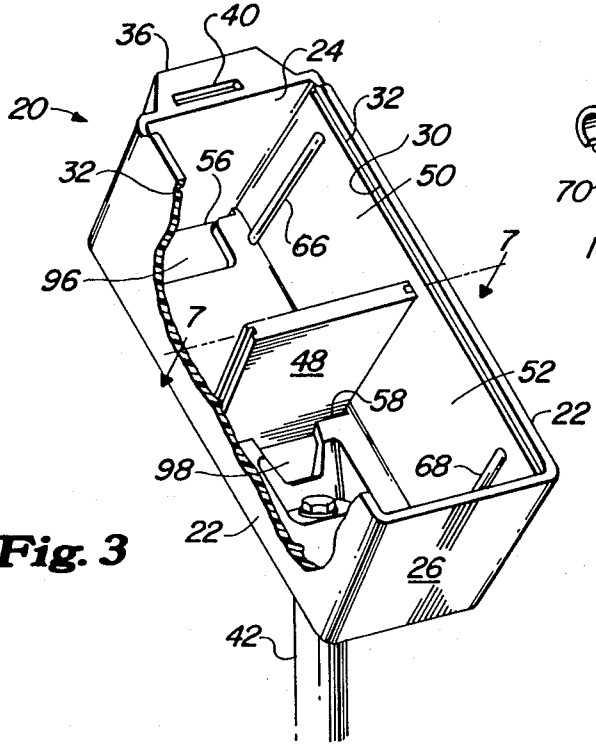
FIG. 3 is a perspective of the basic box.

FIGS. 1 and 2 illustrate one form of the invention chosen for purposes of the present disclosure as comprising a box (20) having opposite side walls (22), a top end (24), a bottom end (26), a back wall (28), with the coplanar front edges of the top and bottom ends and side walls delineating a rectangular open front (30). As best seen in FIG. 8, the front edge portions of the side walls are formed with top-to-bottom tracks or grooves (32) which slidably receive the opposite edge portions of a transparent cover (34), preferably slidable downwardly in the tracks against a stop established by the front edge of the box bottom to close the front of the box and slidably upwardly for removal to gain access to the interior of the box. The top end of the box is provided with a housing portion (36) for containing a key lock having a locking tab (38) which, when in locking position, projects into the path of the top end (40) of the cover. When unlocked, the tab moves downwardly out of the way to enable upward sliding removal of the cover.

Figure 11:
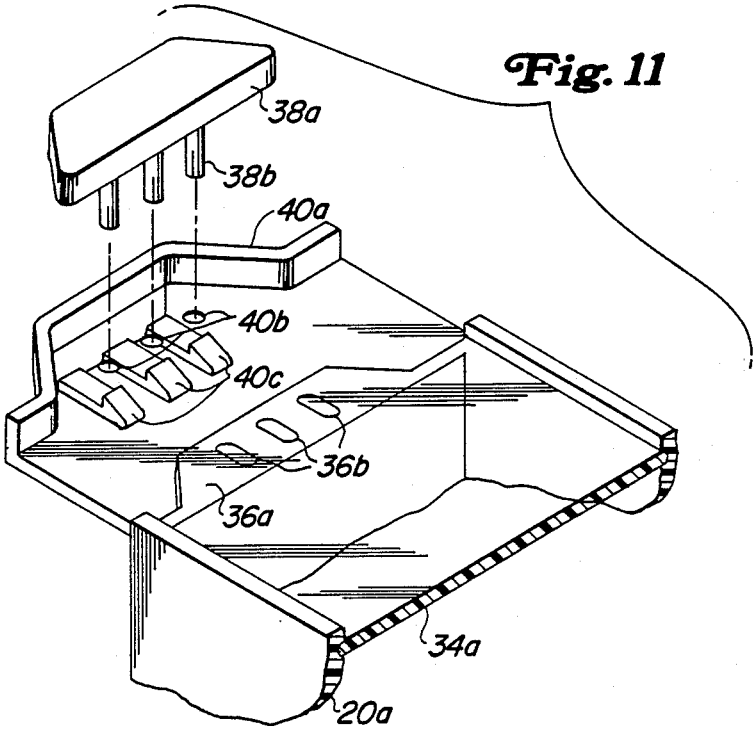
FIG. 11 is an exploded, fragmentary perspective showing one form of cover-locking means.
Figure 12:
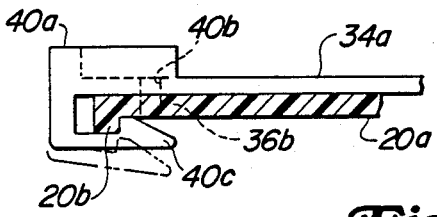
FIG. 12 is a partial section further illustrating the locking means of FIG. 11.

In a modified form of locking means as seen in FIGS. 11 and 12, an extended box (20*a*) has an upper portion (36*a*) and the cover (34*a*) is configured at (40*a*) to overlie the portion (36*a*) when the cover is closed. FIG. 11 shows the cover partly moved upwardly and the portion (36*a*) is seen through the transparent cover as having a plurality of slots (36*b*) which, when the cover is moved to its final closed position, register with holes (40*b*) in the cover. When the cover is completely closed, resilient latches (40*c*) hook under a lug or transverse bar (20*b*) integral with the box (20*a*) (FIG. 12). This mechanism is located at the rear and under portion of the apparatus and is substantially inaccessible from the front of the box. When in closed position the locking device (latches) are fully recessed into the body of the box—this further assures security. A release device (38*a*) has three depending legs or rods (38*b*) (FIG. 11) and is accessible to only authorized personnel and kept separately from the dispenser. When it is desired to release the latches (40*c*), the device is used in such manner that the legs project downwardly through the registered slots and openings (36*b*) and (40*b*) and manual pressure presses the latches (40*c*) out of engagement with the lug or bar (20*b*) (broken lines, FIG. 12).

Primarily as a display advantage, the box is mounted in the sloping position shown by means of a stand (42) rigid with the back wall of the box and having a base (44) for mounting on a counter top, for example, the base being provided with holes (46) for receiving suitable fastening means (not shown). The box could be mounted in other fashions and reference to the box components as front, rear, top, bottom, etc., is for convenience only and not by way of limitation, for, obviously, the box and its components could be otherwise oriented.

The box is shown as being elongated from top to bottom for the purpose of enabling its interior to function as one compartment or as a pair of compartments, the latter phase resulting from the use of a transverse partition (48) which provides upper and lower compartments (50) and (52), respectively. As seen in FIG. 7, the opposite side walls of the box are formed with tracks (54) for receiving opposite grooved edges of the partition, enabling forward removal of the partition when desired. The back wall of the box has two transverse openings or slots, one forming a ticket-exit slot (56) for the upper compartment (50) and the other forming a ticket-exit slot (58) for the lower compartment (52). The upper part of the back wall that forms part of the slot (56) has a knife edge (60) for facilitating tearing off of exiting tickets. The rear edge of the partition (48) is provided with a like knife edge (62) for the same purpose, details that will be elaborated on later herein.

When assembled for operation, the front part of the box (20) carries ticket-display means in the form of a display and guide panel (64) of generally rectangular configuration to fit within the front opening (30) of the box and overlain by the transparent cover (34). Upper and lower stops or locating tracks (66) and (68), here shown as being integral with the side walls (22) (FIG. 9) locate the panel and keep it from shifting from top to bottom and from front to rear. Since the panel fits within the opening (30), it cannot shift laterally. The panel has upper and lower guide elements provided by edge portions (70) and (72), respectively, each of arcuate section about a transverse axis and these abut the stop tracks just described (FIG. 6). The panel has upper and lower, flat, front display faces (74) and (76), respectively, separated by a central transverse opening (78) that combines with the partition (48) to provide two transverse slots (80) and (82) (FIG. 6). The top-to-bottom dimension of the panel (64) is such that its upper and lower arcuate edges (70) and (72) are spaced respectively below and above the top and bottom ends of the box, thus affording upper and lower slots (84) and (86). The portions of the panel that define the top and bottom of the opening (78) are of arcuate section about transverse axes as at (88) and (90) and thus provide guide elements similar to the arcuate edge portions (70) and (72) of the panel (64). These curved edges facilitate travel of ticket series from stacks or supplies (92) and (94) respectively carried in the upper and lower compartments (50) and (52). Those familiar with lottery tickets recognize that the tickets are furnished in series-connected or edge-to-edge chains with perforations between tickets to enable easy tearing of a ticket from its series. In the present case, a quantity of series-connected tickets may be arranged in fan-fold fashion in each compartment (50) and (52), as best seen in FIG. 6.

Reference will be had first to the ticket series (92) in the upper compartment (50). The tickets, folded as stated above, rest on the top of the partition (48) and the lead ticket is fed forwardly through the lower entry slot (80) below the display face (74) and then directed upwardly to draw the foremost tickets over the display face and then rearwardly through the upper re-entry slot (84) and thence rearwardly through the upper exit slot (56). The tickets pass easily about the curved edges (88) and (70) and between the face (74) and the back side of the transparent cover (34), a predetermined number of tickets being visible to the customer through the cover. Tickets emerging at the upper exit slot (56) are easily detached from the series by means of the knife edge (60). When the supply of tickets is exhausted, a new supply is placed in the upper compartment (50).

A similar procedure is followed for the display and dispensing of tickets from the lower compartment. These tickets may be of a different type, as for a different game or lottery or they may represent a further supply of the same type of tickets (92). In any event, the tickets from the lower compartment feed forwardly through the lower ticket-entry slot (86) and upwardly over the lower display face (76) and then to the rear through the re-entry slot (82) for exit via the exit slot (58), being detached at the knife edge (62) at the rear of the partition (48). These tickets are of course displayed at the face (76) via the transparent cover (34).

The ticket supplies are replenished by removing the cover and then the panel (64) for access to the compartments (50) and (52). Additional open areas (96) and (98) may be provided in the back wall adjacent to the exit slots for facilitating initial threading of the tickets through the exit slots. The front faces of the panel (64) have finger openings (100) to enable easier handling of the panel during removal and replacement. Ticket guides in the from of ribs (102) are formed on the faces (74) and (76) to prevent undesirable lateral shifting of the tickets as they pass over the respective faces.

In the event that it is desired to display and dispense only one type of ticket, the ticket supply may be started in either compartment. For example, if only the lower compartment is used, the tickets may be fed in such manner as to travel upwardly over both faces (74) and (76) for exit via the upper re-entry slot (84) and upper exit slot (56). This procedure will increase the number of tickets visible through the cover (34). Further, the partition (48) may be omitted if desired. This is but an example of the versatility of the inventive dispenser.

In the modified form of dispenser shown in Figs. 13, 14 and 15, a box (110) is quite similar to that previously described and has upper and lower ticket-exit slots (112) and (114), respectively. The upper slot is provided with a cut-off member (116) and a like cut-off member (118) is furnished for the lower slot. Unlike the earlier described embodiment, the cut-off member is not part of a partition, because a partition is not used in this embodiment.

The display means for the box (110) comprises a plurality of rollers including upper and lower rollers (120) and (122), respectively, and third and fourth intermediate rollers (124) and (126), respectively. These rollers are journaled on coplanar transverse axes and span the box side walls in close proximity to the coplanar front edges of the box, leaving however enough room for slots (128) for receiving a transparent panel (not shown, but like that described above herein). The upper roller is spaced slightly below the top end of the box to provide a ticket-exit space (130) at about the level of the upper ticket-exit slot (112). The bottom roller is spaced above the bottom of the box to provide a ticket space (132), and the intermediate rollers (124) and (126) are spaced apart to provide a ticket-exit or travel space (134). The arrangement is such that the compartment within the box may hold one or two sets of ticket series for selective dispensing of one or both.

FIG. 14 shows a single stack or fan-folded series of tickets (136) from which the tickets are fed forwardly under the lower roller (122) via the space (132) and thence upwardly to and rearwardly over the upper roller (120) via the space (130) and thence rearwardly through the upper ticket exit slot (112). In this mode, the tickets pass over and are supported by the intermediate rollers (124) and (126).

In the dual ticket mode as seen in FIG. 15, a lower stack of tickets (138) feeds forwardly beneath the lower roller (122) via the space (132) and upwardly to and thence rearwardly over the lower intermediate roller (126) via the space (134) and thence rearwardly for exit through the lower ticket exit slot (114). A second stack of tickets (140) feeds forwardly beneath the upper intermediate roller (124) via the space (134) and thence upwardly to and rearwardly over the top roller (120) via the space (130) for exit through the upper exit slot (112). The function in this respect is very similar to the dispensing of dual stacks of tickets in connection with FIGS. 6 and 10, it being understood, as explained earlier herein, that in that form of the invention, the partition (48) may be removed when one-stage operation is used; that is, handling of one stack of fan-folded tickets.

As noted earlier herein, the dispenser is of simple but sturdy construction and may be made of any suitable light-weight, high-strength material; e.g., plastic or the like. The transparent cover may be of any known plastic material as a substitute for glass because of its known resistance to breakage, discoloration, etc. The panel (64) may be likewise of similar material. The base and stand may be of steel or equivalent material. Features and advantages other than those pointed out will readily occur to those versed in the art, as will many variations in and additions to the preferred embodiment disclosed, all without departure from the spirit and scope of the invention.

I claim:

1. A ticket display and dispenser comprising a box having opposite side walls, top and bottom ends, a back wall and an open front delineated by coplanar front edge portions of the side walls and top and bottom ends and providing a compartment for containing a ticket series made up of a plurality of series-connected tickets, said back wall having a ticket exit slot extending transversely between the side walls; ticket display means carried by the box and including upper and lower transverse guide elements spanning the side walls in close proximity to the front edge portions of the side walls, the upper guide element being generally at the level of the ticket exit slot and the lower guide element being spaced above the bottom of the box to provide a transverse ticket entry slot through which a ticket series is fed forwardly for upward travel over the lower guide element to and rearwardly over the upper guide element for exit through the ticket exit slot.

2. The invention according to claim 1, in which the upper and lower guide elements are rollers.

3. The invention according to claim 2, including third and fourth rollers parallel to and coplanar with the upper and lower rollers, third roller being spaced below the upper roller and the fourth roller being spaced above the bottom roller so as to provide a ticket-exit space between the third and fourth rollers, the back wall having a second ticket-exit slot at about the level of the ticket exit space between the third and fourth rollers, the compartment being thus adapted to contain upper and lower ticket series whereby the lower series tickets are fed forwardly beneath the bottom roller and upwardly to and then rearwardly over the fourth roller for exit through the second ticket exit slot and upper series tickets are fed forwardly beneath the third roller and upwardly to and then rearwardly over the upper roller for exit through the first ticket exit slot.

4. The invention according to claim 1, including a transparent cover closing the open front of the box and overlying the display means.

5. The invention according to claim 4, in which the means mounting the cover on the box includes top-to-bottom-extending tracks in the side walls for top-to-bottom slidable receipt of opposite edges of the cover, stop means rigid on the box and engaging the bottom edge of the cover, and releasable means cooperative between the top of the box and the cover for retaining the cover against upward sliding removal of the cover from the box.

6. The invention according to claim 5, in which the releasable means includes a key-lock device having an element movable selectively between blocking and unblocking relation to the top portion of the cover.

7. The invention according to claim 5 in which the releasable means includes a lug on the box at the top end thereof and below and rearwardly of the plane of the cover, a catch at the top end of the cover for biasing latching with the lug to retain the cover against unauthorized removal, and authorized means for effecting unlatching of the catch from the lug.

8. The invention according to claim 1, in which the portion of the back wall defining the ticket-exit slot has a knife edge for facilitating manual separation of tickets from the ticket series.

9. The invention according to claim 1, in which the ticket display means includes a display panel of rectangular shape carried by the box and juxtaposed over the open front of the box and having a front face substantially coplanar with the front edges of the box, the upper and lower guide elements are respectively upper and lower transverse portions of the panel, the panel serving, to support the upwardly traveling tickets.

10. The invention according to claim 9, including a transverse partition carried by and within the box substantially midway between the top and bottom ends of the box and dividing the box into upper and lower compartments, each adapted to contain a ticket series, the back wall having two ticket-exit slots, one for each compartment, and the display panel having upper and lower display faces respectively closing the upper and lower compartments, said panel providing four transverse slots, including two ticket-entry slots, one below each face, and two ticket-re-entry slots, one above each face, for feeding the respective ticket series over the respective faces for rearward exit through the respective ticket-exit slots.

11. The invention according to claim 10, in which the ticket-exit slot for the lower compartment is substantially at the level of the underside of the partition.

12. The invention according to claim 10, in which the rear edge of the partition has a knife edge generally coincident with the lower ticket-exit slot for facilitating manual separation of tickets from the lower ticket series.

13. The invention according to claim 10, in which the partition is removably carried by the box.

14. The invention according to claim 10, in which each of the display panel portions defining the four slots is of arcuate section about a transverse axis so as to facilitate travel of the ticket series.

15. The invention according to claim 10, in which the display panel and the interior of the box have cooperative inter-engaging portions locating and retaining the panel against top-to-bottom shifting in the box.

16. The invention according to claim 10, in which each display face has projections thereon for guiding and confining the respective ticket series against transverse shifting during travel over the face.

17. The invention according to claim 9, in which the display panel front face has guide means thereon for preventing transverse shifting of the ticket series during travel over the face.

* * * * *